US009549572B2

(12) United States Patent
Dincer et al.

(10) Patent No.: US 9,549,572 B2
(45) Date of Patent: Jan. 24, 2017

(54) SMOKING ARTICLE WITH MOVABLE VAPOUR RELEASE COMPONENT

(71) Applicant: PHILIP MORRIS PRODUCTS S.A., Neuchatel (CH)

(72) Inventors: Ahmet Dincer, Neuchatel (CH); Jerome Uthurry, Neuchatel (CH); Alen Kadiric, Yverdon-les-Baines (CH); Chrystele Houphouet-Boigny, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 432 days.

(21) Appl. No.: 14/356,610

(22) PCT Filed: Nov. 7, 2012

(86) PCT No.: PCT/EP2012/072028
§ 371 (c)(1),
(2) Date: May 7, 2014

(87) PCT Pub. No.: WO2013/068398
PCT Pub. Date: May 16, 2013

(65) Prior Publication Data

US 2014/0299142 A1 Oct. 9, 2014

(30) Foreign Application Priority Data

Nov. 7, 2011 (EP) ..... 11250886

(51) Int. Cl.
*A24F 47/00* (2006.01)
*A24D 3/04* (2006.01)

(52) U.S. Cl.
CPC ..... *A24F 47/002* (2013.01); *A24D 3/041* (2013.01)

(58) Field of Classification Search
CPC ..... A24D 3/041; A24D 3/048
See application file for complete search history.

(56) References Cited

U.S. PATENT DOCUMENTS

RE32,221 E 8/1986 Adams
4,716,912 A 1/1988 Leonard
(Continued)

FOREIGN PATENT DOCUMENTS

EA 005538 4/2005
EP 0 317 154 5/1989
(Continued)

OTHER PUBLICATIONS

European Extended Search Report for Application No. 11250886.6-2313 (5 pages).
(Continued)

*Primary Examiner* — Michael H Wilson
*Assistant Examiner* — Eric Yaary
(74) *Attorney, Agent, or Firm* — Mueting, Raasch & Gebhardt, P.A.

(57) ABSTRACT

The present invention relates to a smoking article having a movable vapour release portion to allow the vapour release portion to be isolated from, or exposed to, a smoke pathway. The invention also relates to a method of manufacturing such smoking articles. In particular, there is provided a smoking article comprising a first segment, a second segment, and an aerosol generating substrate coupled to the first and second segments. At least one of the first and second segments comprises a vapour release portion, whereby the first and second segments are movable relative to each other from a first configuration to a second configuration, whereby in the first configuration the vapour release portion is
(Continued)

substantially isolated from an airflow pathway and in the second configuration the vapour release portion is exposed to the airflow pathway.

24 Claims, 4 Drawing Sheets

(56) References Cited

U.S. PATENT DOCUMENTS

| | | | | |
|---|---|---|---|---|
| 4,904,308 | A * | 2/1990 | Charlton | A24D 3/041 131/198.1 |
| 4,991,605 | A | 2/1991 | Keritsis | |
| 5,439,011 | A * | 8/1995 | Schneider | A24D 3/043 131/336 |
| 8,047,977 | B2 | 11/2011 | Lauenstein | |

FOREIGN PATENT DOCUMENTS

| | | |
|---|---|---|
| EP | 0 630 587 | 12/1994 |
| EP | 0 671 131 | 9/1995 |
| GB | 2288310 | 10/1995 |
| JP | 03-067577 | 3/1991 |
| JP | 07-298866 | 11/1995 |
| RU | 2008140021 | 4/2010 |
| WO | WO 2011/051115 | 5/1989 |
| WO | WO 2008/121610 | 10/2008 |
| WO | WO 2011/107613 | 9/2010 |
| WO | WO 2011/039302 | 4/2011 |

OTHER PUBLICATIONS

Office Action issued in Russia for Application No. 2014123244 dated Aug. 5, 2016 (11 pages). English translation included.

PCT International Search Report and Written Opinion for International Application No. PCT/EP2012/072028 dated Apr. 18, 2013 (11 pages).

Office Action issued in Japan for Application No. 2014-540435 dated Sep. 5, 2016 (6 pages). English translation included.

Office Action issued in Russia for Application No. 2014123244 dated Oct. 14, 2016 (11 pages). English translation included.

* cited by examiner

SMOKING ARTICLE WITH MOVABLE VAPOUR RELEASE COMPONENT

This application is a U.S. National Stage Application of International Application No. PCT/EP2012/072028, filed Nov. 7, 2012, which was published in English on May 16, 2013, International Patent Publication WO 2013/068398 A1. International Application No. PCT/EP2012/072028 claims priority to European Application No. 11250886.6 filed Nov. 7, 2011.

The present invention relates to a smoking article having a movable vapour release portion to allow the vapour release portion to be isolated from, or exposed to, a smoke pathway. The invention also relates to a method of manufacturing such smoking articles.

Various types of smoking articles are known, including some smoking articles in which smoking material is combusted and other non-combustion smoking articles in which no combustion occurs. As an example of a combustion smoking article, filter cigarettes typically comprise a cylindrical filter aligned in an end-to-end relationship with a wrapped tobacco rod, with the filter attached to the tobacco rod by tipping paper. In such filter cigarettes, the filter may consist of a plug of a fibrous filtration material, such as cellulose acetate tow, wrapped in porous plug wrap. The filter may also comprise a flavour component such as a flavour thread or a flavour capsule. Conventionally, the wrapped tobacco rod and the filter are joined by the tipping wrapper which is typically formed of a band of paper material that circumscribes the entire length of the filter and an adjacent portion of the wrapped tobacco rod.

As an example of a non-combustion smoking article, a number of smoking articles in which tobacco is heated rather than combusted have been disclosed. In heated smoking articles, an aerosol is generated by heating a flavour generating substrate, such as tobacco. Known heated smoking articles include, for example, electrically heated smoking articles and smoking articles in which an aerosol is generated by the transfer of heat from a combustible fuel element or heat source to a physically separate aerosol forming material. During smoking, volatile compounds are released from the aerosol forming substrate by heat and entrained in air drawn through the smoking article. As the released compounds cool they condense to form an aerosol that is inhaled by the consumer. As another example of a non-combusted smoking article, smoking articles in which a nicotine-containing aerosol is formed from a tobacco material or other nicotine source without combustion and without addition of heat have been disclosed, such as those described in WO-A-2008/121610 and WO-A-2010/107613. In these types of smoking articles, a chemical source is provided to generate the nicotine-containing aerosol.

It has previously been proposed to provide smoking articles with movable elements to alter the filtration level, or to change the level of flavour delivered to a smoker during smoking of the smoking article. For example, flavour capsules have been proposed that may be ruptured to release flavour on relative movement of filter components. In addition, flavour threads have been proposed that may be drawn into the filter from outside the filter to provide change the level of flavour delivered.

It would thus be desirable to provide a smoking article having a different organoleptic experience for the smoker, with a first configuration in which a flavour is isolated from the flow of air through the smoking article and a second configuration in which the flavour is exposed to the flow of air. It would also be desirable to provide a smoking article with controllable flavour release.

According to a first aspect of the present invention there is provided, a smoking article comprising a first segment, a second segment, and an aerosol generating substrate coupled to the first and second segments. At least one of the first and second segments comprises a vapour release portion. The first segment and the second segment are movable relative to each other from a first configuration to a second configuration such that the smoking article is provided with a changeable length, wherein in the first configuration the first segment and the second segment interact to form an airflow pathway that does not incorporate the vapour release portion and the vapour release portion is substantially isolated from an airflow pathway and in the second configuration the vapour release portion is exposed to the airflow pathway.

As used herein, the term "airflow pathway" connotes the entire pathway along which air flows through the smoking article, for example from the rod end of the aerosol generating substrate, through the aerosol generating substrate itself, and then to the mouth end of the smoking article.

The term "isolated" connotes that the release of the vapour components within the vapour release portion into the airflow pathway is inhibited, and thus the vapour components are limited in their ability to contribute to the organoleptic properties of the aerosol. On the contrary, the term "exposed" connotes that the vapour components within the vapour release portion are open to the airflow pathway relative to the isolated configuration to contribute to the organoleptic sensation of the smoker.

As used herein, the term "longitudinal" refers to the direction along the central axis of the smoking article, and the term "transverse" refers to the direction perpendicular to the longitudinal direction. The terms "end surface" and "side surface" refer to surfaces, or walls, of components of the smoking article that are parallel to the transverse direction and parallel to the longitudinal direction respectively. The terms "mouth end" and "rod end" refer to the ends of the smoking article closest to the smoker's mouth, and furthest from the smoker's mouth respectively.

By providing a smoking article with such first and second configurations the smoker may be provided with the advantage of vapour release on demand. The smoker may be provided with the advantage of controlling the level of vapour from substantially zero. Thus the smoker may be provided with an improved organoleptic control. Furthermore, the shelf-life of the smoking article may be improved because the volatile vapour components are substantially isolated from the airflow pathway, and hence are retained within the vapour release portion more effectively during storage. In this way, the vapour components within the vapour release portion may be better contained prior to the desired release of the vapour on movement of the first and second segments from the first configuration to the second configuration.

The aerosol generating substrate of the present invention contains tobacco or another nicotine-containing substance. As such, smoking articles according to the present invention may comprise an aerosol generating substance in which tobacco material is heated to form the aerosol, rather than combusted. Alternatively, a nicotine-containing aerosol may be generated from a tobacco material, tobacco extract, or other nicotine source, without combustion or heating. In a further alternative, the aerosol generating substrate may be a tobacco rod or the like. In this case, the tobacco rod is preferably formed from a tobacco material adapted to be combusted to form an aerosol in the form of smoke, such as with a cigarette or other combustible smoking article.

The term "vapour" refers to any agent that can be incorporated into a component of a smoking article in order to provide an effect on the aerosol or smoke generated during smoking. The vapour may be, for example, a substance that is capable of reducing one or more constituents of the aerosol. Alternatively, the vapour may be a substance that is capable of reacting with one or more other substances in the smoking article to produce, either directly or indirectly, an aerosol. In preferred embodiments of the invention, the vapour is a flavour composition and the vapour release portion is adapted to be loaded with the flavour composition. The vapour may be loaded into the flavour release portion as a liquid which subsequently vaporises to provide the vapour.

In the following description, the invention will be described with reference to a flavour release portion that is adapted to be loaded with a flavour composition. However, it will be clear that the teaching can also be applied to a material for the release of an alternative vapour.

The first segment and second segment each may be any component of the smoking article, and may be positioned at any longitudinal position along the smoking article. Preferably, the first segment and the second segment form at least a portion of a mouthpiece of the smoking article. More preferably, the first segment and second segment form at least a portion of a multi-component filter positioned at the mouth end of a smoking article.

The first segment and the second segment may interact to substantially isolate the flavour release portion from the airflow pathway. In more detail, the first segment and the second segment interact to form an airflow pathway that does not incorporate the flavour release portion. As such, in the first configuration, the first segment and second segment are preferably arranged to form a compartment, such as a container, that is adapted to substantially isolate the flavour release portion from the airflow pathway. In the second configuration the flavour release portion is exposed to the airflow pathway, and hence moving the smoking article into the second configuration opens the compartment to the airflow pathway.

Preferably, in the second configuration, the first segment and the second segment are arranged to define a cavity. More preferably, the cavity is defined around the first segment, and may aid with the mixing of the flavour components released from the flavour release portion and the airflow flowing through the smoking article.

The first segment and second segment may further be adapted to provide a third configuration. The third configuration may expose an additional flavour release portion to the airflow pathway. The additional flavour release portion may contain the same flavour as the flavour release portion or a different flavour to the flavour release portion. Where the flavour is the same the concentration of flavour components within the additional flavour release portion may be the same, lower or higher than the concentration of flavour components within the flavour release portion. The first segment and the second segment may move in a first relative direction to move from the first configuration to the second configuration, and in a second relative direction to move to the third configuration. Alternatively, the first segment and the second segment may move further in the first relative direction to move to the third configuration. The third configuration is discussed in further detail below.

In the first configuration, the compartment may be adapted to block the release of volatile or liquid flavour substances from the flavour release portion into the airflow pathway. In this way, the flavour release portion may be isolated from the airflow pathway such that release of the flavour is limited or entirely prevented from the flavour release portion until the smoking article is in the second configuration. As discuss above, this may increase the shelf-life of the smoking article. Where the flavour is completely isolated, or entirely prevented from release into the airflow pathway, the compartment may provide a sealed area to contain the flavour release portion. The sealed area may be a hermetically sealed area.

In a preferred embodiment, only longitudinal movement of the segments relative to each other is required to move from the first configuration to the second configuration. In this preferred embodiment, the first segment and second segment may be configured such that they can rotate relative to each other about a central, longitudinal, axis of the smoking article without moving from the first configuration to the second configuration or opening the compartment. Alternatively, the smoking article may be provided with a mechanism to prevent relative rotational movement between the first segment and the second segment. The mechanism for preventing relative rotational movement may comprise a guide portion provided on the first segment or the second segment, and a corresponding portion configured to engage with the guide portion on the respective second segment or first segment. The guide portion may be a longitudinal channel, or plurality of spaced apart channels.

Where the compartment formed by the first segment and second segment is a container, at least one wall of the container is preferably formed from a wall of the first segment, and at least one further wall of the container is formed from a wall of the second segment. In some embodiments, two end walls of the container are formed from two end walls of the first segment and the longitudinal wall or walls of the container are formed from longitudinal wall or walls of the second segment. In other embodiments, two end walls of the container are formed from two end walls of the second segment and the longitudinal wall or walls of the container are formed from longitudinal wall or walls of the first segment.

The walls forming the container are preferably substantially impermeable, such that the flavour substance in the flavour release portion cannot freely migrate out of the container through the container walls. In the second configuration, one or more of the walls of the flavour release portion exposed to the airflow pathway are permeable, such that the flavour substance in the flavour release portion may be released into the aerosol.

Preferably, the first and second segments are movable relatively to each other such that the smoking article is provided with a changeable length. The first segment may be movable relative to the second segment, such that in the first configuration the longitudinal length of the smoking article is shorter than in the second configuration. Alternatively, in the first configuration, the longitudinal length of the smoking article may be longer than in the second configuration.

The flavour release portion may be within the first segment, or within the second segment.

Where the first segment comprises the flavour release portion, the second segment defines a cavity that is adapted to receive at least a section of the flavour release portion. Preferably, in the second configuration a section of said flavour release portion remains partially within the cavity. In this embodiment, the second segment may be a hollow cylinder, the cylinder defining a hollow space that preferably has a substantially circular cross-section. Alternatively, the cross-sectional shape may be any other suitable shape, such as elliptical, triangular, or rectangular. By providing a segment that remains partially within the defined cavity, the flexural rigidity of the smoking article in the second configuration may be increased.

As such, in a preferred embodiment, the first segment is a corresponding rod adapted to be inserted into the cavity defined by the second segment. Where the second segment is a hollow substantially circular cylinder, the first segment is preferably an elongate rod having a substantially corresponding circular cross-section. Preferably, the elongate rod has a cross-sectional shape that corresponds to the cross-sectional shape of the cavity and is adapted to form a tight fit within the cavity of the second segment.

The flavour release portion may have substantially impermeable end surfaces and a permeable side surface, and said cavity has a substantially impermeable inner surface such that in the first configuration the impermeable surfaces form a flavour container to isolate the flavour release segment from the airflow pathway.

In an alternative embodiment, the second segment may comprise the flavour release portion and defines a cavity that is adapted to receive at least a section of the first segment. The first segment has permeable end surfaces and a substantially impermeable side surface, and the second segment has a permeable inner surface and substantially impermeable end surfaces, such that in the first configuration the impermeable surfaces form a flavour container to isolate the flavour release segment from the airflow pathway.

The smoking article may also comprise two or more flavour release portions. Each flavour release portion may comprise a different flavour substance, or the same flavour substance.

In the first configuration the flavour container may act to substantially seal the flavour release portion from the airflow pathway.

The first segment may further comprise a filter segment coupled to the flavour release portion. In this embodiment, the smoking article further preferably comprises a first tipping paper wrapped around the second segment, and a second tipping paper wrapped around the filter segment, wherein in the first configuration the first and second tipping papers overlap one another a first distance, and in the second configuration the first and second tipping papers overlap a second distance. Where the smoking article is lengthened to move from the first to the second configuration, the second distance is less than the first distance. Where the smoking article is shortened to move from the first to the second configuration, the second distance is greater than the first distance. In some embodiments, the first tipping is wrapped around the second tipping, while in other embodiments the second tipping is wrapped around the first tipping. The tipping in the outside may be referred to as the outer tipping and the tipping on the inside may be referred to as the inner tipping.

Preferably, the first and second tipping papers comprise retention means adapted to retain the first tipping paper and second tipping paper together when the first segment and the second segment are moved apart longitudinally. The retention means may comprise opposing features on the first and second tipping papers. Preferably, the features are raised portions of the tipping papers. Preferably, the raised portions are formed by folding the tipping paper. The retaining means on the inner tipping paper is preferably formed by folding the tipping paper towards the exterior of the smoking article. The retaining means on the outer tipping paper is preferably formed by folding the tipping paper towards the interior of the smoking article.

The filter segment may be a rod end segment or a mouth end segment and may comprise a filter material, such as cellulose acetate tow. Alternatively, the filter segment may not provide any filtration of the aerosol. Where the cylindrical filter segment is a filter, the filter may comprise a flavour substance. The flavour substance may be loaded on a flavour thread, or be provided in the form of flavour crystals, flavour capsules, or loaded directly onto the filter material. The flavour may be the same or different to the flavour loaded in the flavour release portion.

The first segment and the second segment may also be movable from the second configuration to the first configuration, whereby the flavour release segment is substantially isolated. Providing a first segment and a second segment that are also movable from the second configuration to the first configuration may provide the advantage of allowing the flavour release to be reversible. As such, the smoker may be provided with the option of having flavour release during the initial smoking of the smoking article, and then stopping the flavour release at some point during smoking.

The first segment and the second segment may be movable to a third configuration. In such embodiments, the flavour release portion preferably includes a first flavour section and a second flavour section. Each of the first and second sections may form separate compartments or containers, as mentioned above. In the first configuration, both the first and second flavour sections are isolated from the airflow pathway. In the second configuration, the first flavour section is exposed to the airflow pathway, but the second flavour section remains isolated from the airflow pathway. In some embodiments, in the third configuration both the first and the second flavour sections are exposed to the airflow pathway. In other embodiments, in the third configuration the first flavour release section is isolated and the second flavour release section is exposed to the airflow pathway.

The first section of the flavour release portion may comprise a first flavour component, and the second section of the flavour release portion may comprise a second flavour component.

According to a further aspect of the present invention, there is provided a smoking article as described herein, whereby the first segment and second segment are adapted to form a multi-component filter, and the aerosol generating substrate is a tobacco rod. In the first configuration, the flavour release portion is substantially isolated from a smoke pathway, and, in the second configuration, the flavour release portion is exposed to the smoke pathway.

The flavour release portion is loaded with at least one flavour component in the form of a flavourant. The flavour release portion may be loaded with any flavourant or combination of flavourants capable of releasing flavour into a mainstream aerosol drawn through the smoking article.

The flavour release portion may be loaded with two or more flavourants of the same or different types. For example, the flavour release portion may be loaded with one or more natural flavourants or with one or more synthetic flavourants or with a combination of one or more natural flavourants and one or more synthetic flavourants.

Flavourants suitable for use in the invention are well known in the art and include, but are not limited to, essential oils (for example, cinnamon essential oil, eucalyptus essential oil, peppermint essential oil and spearmint essential oil), oleoresins (for example, ginger oleoresin and clove oleoresin), absolutes (for example, cocoa absolute), fruit concentrates, botanical and fruit extracts (for example, blueberry extract, cranberry extract, geranium extract, green tea extract, orange extract and vanilla extract), and combinations thereof.

Other flavourants suitable for use in the invention are also well known in the art and include, but are not limited to, menthol, vanillin and combinations thereof.

In a particularly preferred embodiment of the invention, the flavour release portion is loaded with menthol.

Where the flavour release portion comprises a plurality of flavour sections, each section may be loaded with a different flavour, or the same flavour in different concentrations. Alternatively, each section may be loaded with a combination of flavours, each section being loaded with a different combination, or the same combination in different concentrations.

As such, various flavouring regimes may be provided by the smoking article of the present invention. A first regime, as described above in detail, preferably provides substantially no additional flavour to the aerosol when the smoking article is in the first configuration, whereas a single flavour is added to the aerosol in the second configuration. A second regime preferably provides substantially no additional flavour to the aerosol when the smoking article is in the first configuration, and a plurality of flavours in the second configuration. A third regime preferably adds a first flavour to the aerosol when the smoking article is in the first configuration, and adds a second flavour to the aerosol when in the second configuration. In the third regime, the first and second flavours may be the same or different. It should be understood that any suitable combination of the above flavouring regimes are also disclosed.

In the embodiment comprising a third configuration, further flavouring regimes are provided. A fourth regime preferably provides substantially no additional flavour or an initial flavour to the aerosol when the smoking article is in the first configuration, adds a first flavour to the aerosol in the second configuration and adds a second flavour to the aerosol in the third configuration. In this embodiment, the first and second flavours may be the same or different.

The level of flavour delivery of the flavour release portion used in the present invention may be demonstrated by determining the amount of a flavour component that is released from the flavour release portion during smoking when the smoking article is in both the first configuration and the second configuration. A suitable test may be set up to measure the total amount (for example, in micrograms) of the flavour component that is released into the airflow pathway of the smoking article when the smoking article is smoked, for example under ISO conditions. For example, during smoking, the particulate phase of the mainstream smoke may be collected in a suitable trap or filter and the collected smoke sample is then extracted in a suitable solvent and analysed using gas chromatography to identify the levels of different components within the smoke.

One example of such a method for quantifying the amount of menthol released during smoking is the Menthol In Smoke (MIS) test. The skilled person would appreciate that similar tests could alternatively be used to quantify the amount of other vapour components that may be released into the airflow pathway.

Measured using such a method, the level of flavourant released during the smoking of the smoking article in the first configuration may be measured by testing a number of smoking articles entirely while in the first configuration. In addition, the level of flavourant released during the smoking of the smoking article in the second configuration may be measured by testing a number of smoking articles entirely while in the second configuration. In the first configuration, the amount of flavourant released is preferably less than about 0.5 mg, more preferably less than about 0.1 mg, and most preferably less than about 0.05 mg. In addition or in the alternative, the amount of flavourant released in the first configuration is greater than about 0.01 mg. More preferably, the amount of flavourant released in the first configuration is undetectable. In the second configuration, the amount of flavourant released is greater than the amount of flavourant measured in the first configuration and is preferably greater than about 0.5 mg, more preferably greater than about 0.8 mg, and most preferably greater than about 1.0 mg. In addition or in the alternative, the amount of flavourant released in the second configuration is less than about 2.0 mg. In addition or in the alternative, the amount of flavourant released in the second configuration is preferably at least about 1.5 times and more preferably at least about 2.0 times, the amount of flavourant released in the first configuration. In addition or in the alternative, the amount of flavourant released in the second configuration is at least about 0.3 mg higher than the amount of flavourant released in the first configuration, and is more preferably at least about 0.5 mg higher. In a preferred embodiment, all of the flavourant levels referred to above relate to menthol in the smoke.

In use, the smoker moves the smoking article from the first configuration to the second configuration by longitudinally moving the first segment relative to the second segment. For example, the first segment could be moved longitudinally away from, or toward, the second segment, when moving from the first to the second configuration. This acts to expose the flavour release portion to the airflow pathway. The smoker then smokes the smoking article in the conventional manner known in the art. During the smoking process, the smoker may move the smoking article from the second configuration to the first configuration to isolate the flavour release portion from the smoke pathway, and hence substantially reduce or stop the flavour release.

To provide the smoker with an indication of which configuration the smoking article is in, an indicator may be provided on the wrapper material. As such, at least one of the first tipping paper and the second tipping paper may comprise at least one indicator, whereby in the first configuration the indicator is not exposed, and in the second configuration the at least one indicator is exposed. The indicator may be a different colour on the first tipping paper, such that the different colour of tipping paper is exposed when the smoking article is in the second configuration. The indicator may be a series of printed bands or lines extending around the entire circumference of the smoking article, or only around a portion of the smoking article, such that a progressive number of bands are exposed as the smoking article is moved from the first configuration to the second configuration. In this embodiment, the level of flavour release may be varied in dependence on the number of bands exposed by the smoker. In this embodiment, the indicator may alternatively be a series of ascending numbers, the numbers ascending to a maximum corresponding with maximum flavour release.

At least one of the first and second segments may comprise filtration material. Preferably, both the first and second segments comprise filtration material, more preferably fibrous filtration material, most preferably cellulose acetate.

Preferably, the external diameter of filters according to the invention is between about 4.5 mm and about 8.5 mm, more preferably between about 7.7 mm and about 8.1 mm, most preferably about 7.9 mm.

Preferably, the overall length of filters according to the invention is between about 17 mm and about 36 mm, more preferably between about 24 mm and about 30 mm, most preferably about 27 mm.

According to a further aspect of the present invention there is provided a method for manufacturing a multi-component filter as described herein. The method comprises the steps of forming the first segment from a continuous rod of material. The flavour substance is preferably loaded on the continuous rod of material prior to forming the first segments. The continuous rod of material may be provided with a highly porous wrapper material. The continuous rod of material used to form the first segments is then cut into a plurality of first segments, and impermeable end surfaces are formed on the first segment, for example using heat or a chemical such as plasticizer. Preferably, the continuous rod of material is manufactured from a continuous fibre filter material, such as a cellulose acetate tow, or a randomly oriented fibre material. The method further comprises wrapping the first segments with a substantially impermeable material to form a slidable layer covering the first segments. The impermeable material is preferably glued, or otherwise permanently attached, to itself along a join line. Filter material is introduced to surround the impermeable material to form the second segment. The filter material is preferably glued to the impermeable material by introducing a glue layer to the impermeable material before introducing the filter material. A wrapper material, such as a highly porous wrapper material, is then introduced to wrap the second segment material, and is preferably glued to the external surface of the second segment filter material. The combined first segments and second segments are then preferably cut into double length filter elements. Finally, the double length filter elements are alternately combined with double length mouth end segments. Each face of the double length mouth end segment is glued to the end face of a corresponding first segment.

Either on-line or off-line, the filter elements are cut into individual length filter elements and combined with a tobacco rod by wrapping the tobacco rod and filter element in a wrapping material. Finally, a further wrapper is applied around the mouth end of the filter element to couple the first segment to the second segment.

The invention extends to methods and/or apparatus substantially as herein described with reference to the accompanying exemplary drawings.

As used herein, means plus function features may be expressed alternatively in terms of their corresponding structure.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will now be further described with reference to the following exemplary drawings in which.

Figure 1B:
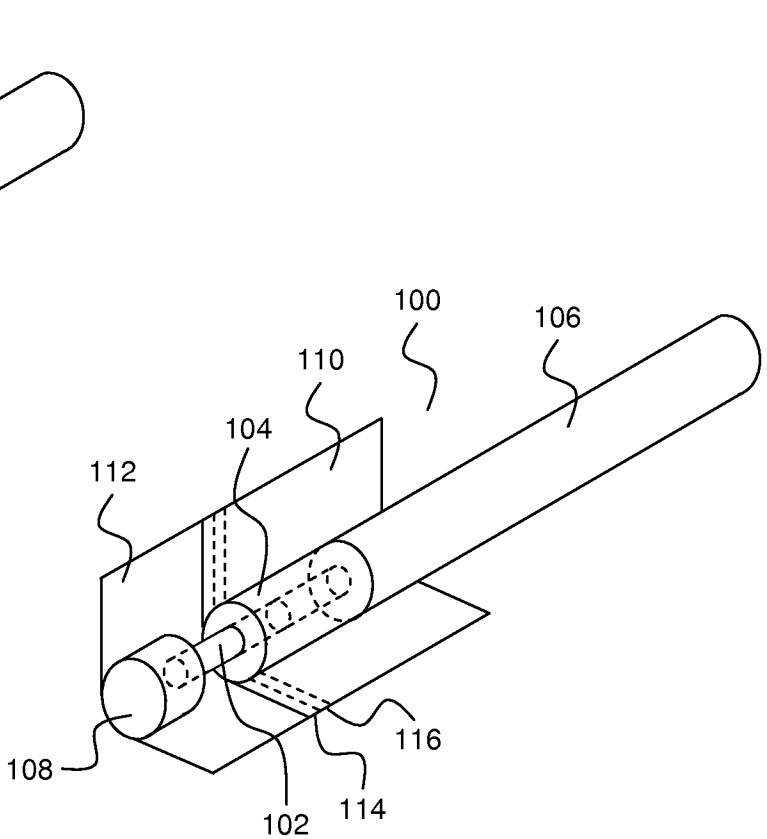
FIGS. 1 show perspective views of a smoking article, according to the present invention, in non-extended and extended configurations respectively.
Figure 1A:
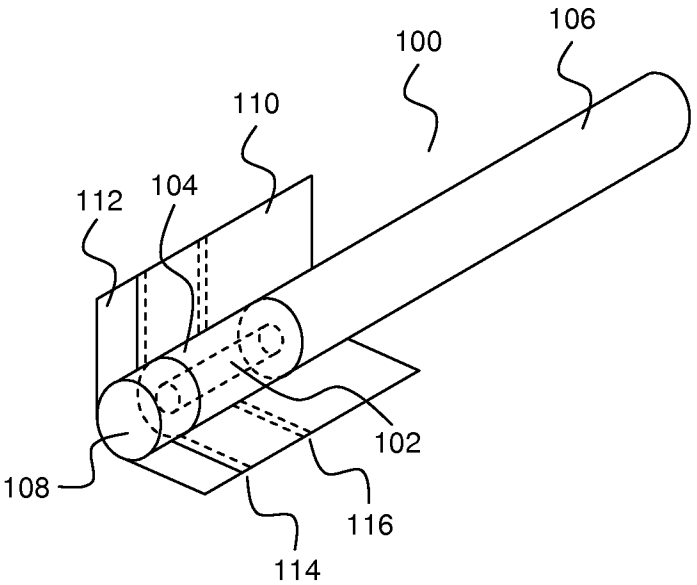

FIG. 1(*a*) shows a perspective view of a smoking article 100, the smoking article comprises a first segment 102, a second segment 104, a wrapped tobacco rod 106, and a mouth end segment 108. The components of the smoking article are coupled together by wrapper papers 110 and 112. The first segment 102 is coupled to the mouth end segment 108, and is slidably positioned within the second segment 104. The second segment 104 is coupled to the tobacco rod 106 by wrapper material 110, such as a tipping paper. The wrapper material 112, such as a tipping paper, is wrapped over the wrapper material 110, and is glued to the mouth end segment 108. The wrapper material 112 overlaps the wrapper material 110 by approximately 6 mm in this example.

In this first configuration, a flavour release portion, loaded with a flavour substance such as menthol, of the first segment 102 is substantially isolated from the smoke pathway. The smoke pathway proceeds through the tobacco rod 106, through the second segment 104, and then through the mouth end segment 108. As described in further detail below, the end surfaces of the first segment 102 and the inner side surface of the second segment 104 are impermeable, and thus the smoke does not pass through the first segment 102.

FIG. 1(*b*) shows the smoking article 100 shown in FIG. 1(*a*) in a second configuration. In this second configuration, the smoking article has been extended by moving the mouth end segment 108, which is directly coupled to the first segment 102, longitudinally relative to the second segment 104, which is directly coupled to the tobacco rod 106. Thus, the permeable outer side surface of the first segment 102 is exposed to the smoke pathway, and the flavour substances are released into the smoke pathway.

In this second configuration, the first segment 102 is prevented from being removed from the second segment 104 be the retaining means 114 and 116. The retaining means 114 and 116 are folds in the wrapper material 110 and 112 respectively. The fold 114 is towards the exterior of the smoking article, and the fold 116 is towards the interior of the smoking article. In this example, the folds are approximately 1 mm in width. The retaining means 114 and 116 are arranged such that the folds engage when the smoking article is in the second, extended, configuration. In this example, the smoking article is approximately 5 mm longer in the second configuration than in the first configuration.

Figure 2A:
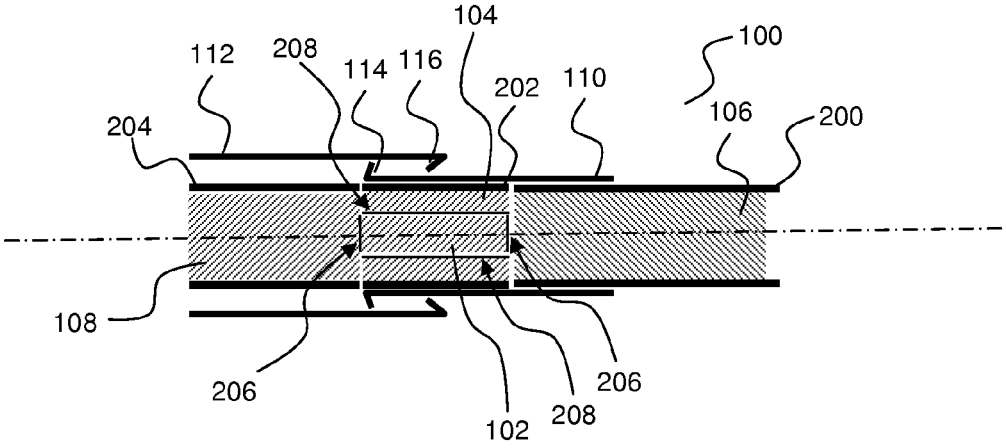
FIGS. 2 show schematic representations on the smoking article shown in FIGS. 1.
Figure 2B:
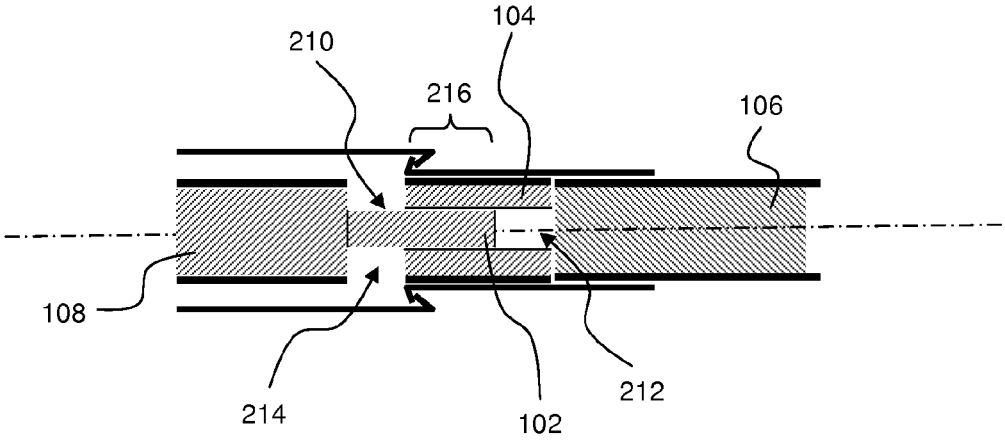

FIGS. 2 show a cross-sectional view of the smoking article 100 shown in FIGS. 1. As can be seen in FIG. 2(*a*), the wrap 200 of the tobacco rod 106 is shown. As described above, the tobacco rod 106 is directly coupled to the second segment 104 by the wrapper 110. The second segment 104 is wrapped by plug wrap 202, and then over-wrapped by the wrapper 110. The mouth end segment 108 is wrapped by plug wrap 204, and then over-wrapped by the wrapper 112. The first segment 102 comprises a flavour release portion that is loaded with a flavour substance. The end surfaces 206 of the first segment 102 are impermeable to the flavour substance. The second segment 104 is provided with an impermeable inner side surface 208. The inner side surface 208 of the second segment 104 are impermeable to the flavour substance loaded in the flavour release portion, forming a compartment such as a container.

FIG. 2(*b*) shows a cross-sectional view of the smoking article 100 in the second configuration. In this second configuration, the retaining flaps 114 and 116 engage to prevent the mouth end segment 108 and first segment 102 from being removed from the second segment 104 and tobacco rod 106. As can be seen, the first segment remains partially within the second segment to provide additional flexural rigidity to the smoking article. In this example, approximately 7 mm of the first segment remains within the second segment. As described above, in this second configuration the flavour release portion in the first segment 102 is exposed to the smoke pathway via the outer side surface 210 of the first segment 102. Thus the flavour substance is released into the smoke to provide the smoker with a desired organoleptic experience. The cavity 212 defined by the second segment 104 is shown.

The cavity 214 defined by an end surface of mouth end segment, an end surface of the second segment 104, the inner side surface of the wrapper 112, and the outer side surface of the first segment 102, allows for the flavour substance to mix with the smoke.

The portion 216 of the wrapper material 110 is provided with an indicator to show the smoker that the smoking article is in the second, extended configuration. The indicator may be a different colour, a series of printed bands, or numbers.

In use, the smoker may either light and smoke the smoking article in the conventional way, or the smoker may extend the filter to expose the flavour substance prior to smoking, or during the smoking, of the smoking article. If required, the smoker may move the smoking article into the first configuration during smoking to substantially isolate the flavour release portion and thus stop flavour delivery.

Figure 3:
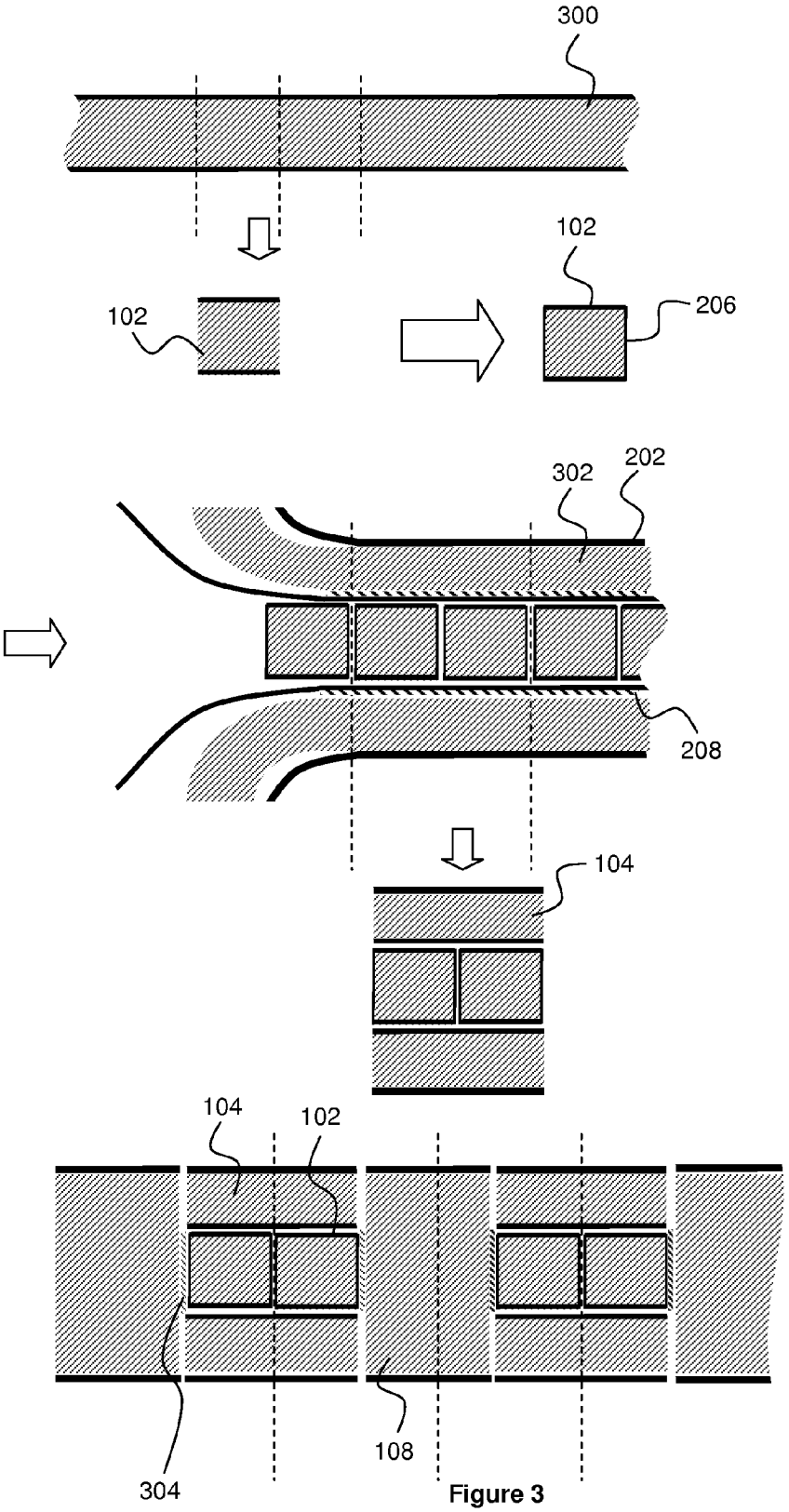
FIG. 3 shows a schematic representation of the process for manufacturing a smoking article according to the present invention.

FIG. 3 shows a method of manufacturing the filter of the smoking article 100. The first segment 102 comprising the flavour release portion is manufactured from cellulose acetate tow and wrapped with a high porous paper plug wrap. The flavour substance is added to the filter material just before manufacture of the continuous rod 300 of first segment filter. The continuous rod 300 is then cut to form the first segments 102. The first segments 102 are then provided with impermeable end surfaces 206. The impermeable surfaces are manufactured by cauterising the end surface of the cut first segment or by a coating process to deposit a plasticiser or the like. The process of providing impermeable surfaces is conducted off-line.

The first segments are then introduced into a filter combiner, and wrapped with impermeable material. No glue is applied between the first segment outer surface and the impermeable material since the impermeable material will act as the inner side surface of the second segment. Filter material 302, such as cellulose acetate tow, is then introduced, and glued 208 to the outside of the impermeable material to form the second segment. In addition, a permeable wrapper material 202 is introduced around the filter material of the second segment to complete the combination of first segment and second segments. Since no glue is applied between the impermeable material and the first segment, the first segment and second segment are slidable longitudinally relative to each other. The continuous second segment 302 is then cut into double length sections.

Finally, the mouth end segments 108 are introduced and glued 304 to the first segments 102, and then the filters are cut to form individual filter elements.

Either in the same online process, or in a separate off-line process the filter elements are then combined with the tobacco rods. In this process, the second segment 104 is coupled to the tobacco rod 106 using wrapper material 110. The wrapper material 110 is pre-folded with retaining means 114. The wrapper material 112 is then wrapped over the wrapper 110 to complete the smoking article. The wrapper material 112 is pre-folded with retaining means 116.

Figures 4A, 4B, 4C:
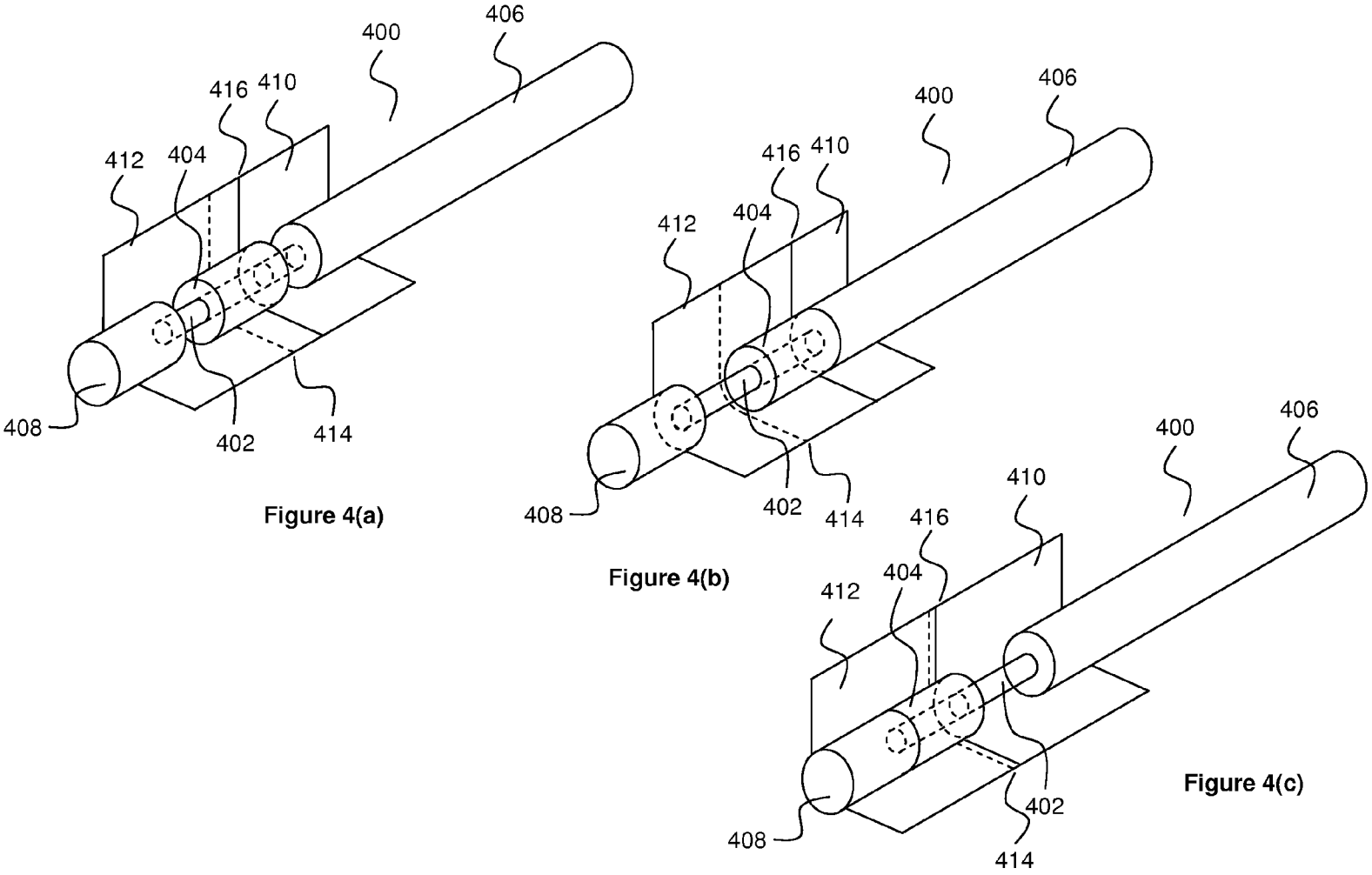
FIG. 4 shows a schematic representation of an alternative embodiment of a smoking article according to the present invention.

FIGS. 4 show an alternative embodiment of a smoking article 400 according to the invention. The smoking article 400 is similar to the smoking article 100 described above. In this embodiment, the first segment 402 comprises a flavour release portion with two sections. In a first configuration, the two sections are substantially isolated from the airflow pathway by the second segment 404. The second segment 404 is movable relative to the first segment 402. When the second segment 404 is moved to a second configuration by sliding the second segment longitudinally along the first segment in a first direction (shown in FIG. 4(*b*)), the first section of the flavour release portion is exposed to the airflow pathway. In this second configuration, the second section of the flavour release portion is substantially isolated from the airflow pathway. When the second segment 404 is moved to a third configuration by sliding the second segment longitudinally along the first segment in a second direction (shown in FIG. 4(*c*)), the second section of the flavour release portion is exposed to the airflow pathway. In this third configuration, the first section of the flavour release portion is substantially isolated from the airflow pathway.

The first segment 402 is positioned within the second segment 404, and the first segment 402 is directly coupled to the tobacco rod 406 via an upstream plug (not shown) and the mouth end segment 408. The wrapper material 410 is attached to the tobacco rod 406, and allows the second segment 404 to slide relative to the first segment 402. The wrapper material 412 is attached to the second segment 404, and is slidable inside of the wrapper material 410, and outside of the mouth end segment 408.

The second segment is slidably positioned on the first segment, and can be moved from the first configuration shown in FIG. 4(*a*), to a second configuration shown in FIG. 4(*b*), and to a third configuration shown in FIG. 4(*c*).

The first segment 402 comprises two flavour release portions positioned. Each flavour release portion is loaded with a different flavour, such that when the smoking article is in the second configuration a first flavour is released into the mainstream smoke, and in the third configuration a second flavour is released into the mainstream smoke.

It will be appreciated that whilst the specific embodiments described above relate to smoking articles comprising a filter and a tobacco rod, a similar arrangement of the flavour release portion could also be used on a non-combustible smoking article, as described above.

The invention claimed is:

1. A smoking article comprising:

a first segment;

a second segment; and an aerosol generating substrate coupled to the first and second segments;

wherein at least one of the first and second segments comprises a vapour release portion;

wherein the first and second segments are movable relative to each other from a first configuration to a second configuration such that the smoking article is provided with a changeable length;

wherein in the first configuration the first segment and the second segment interact to form an airflow pathway that does not incorporate the vapour release portion, the vapour release portion being thus substantially isolated from the airflow pathway, wherein in the second configuration the vapour release portion is exposed to the airflow pathway, wherein the first segment comprises the vapour release portion and the second segment defines a cavity that is adapted to receive at least a section of the vapour release portion, wherein in the second configuration a section of said vapour release portion remains partially within the cavity, and wherein said vapour release portion has substantially impermeable end surfaces and a permeable side surface, and said cavity has a substantially impermeable inner surface such that in the first configuration the impermeable surfaces form a vapour container to isolate the vapour release portion from the airflow pathway.

2. A smoking article according to claim 1, wherein the first segment is movable relative to the second segment, such that in the first configuration the longitudinal length of the smoking article is shorter than in the second configuration.

3. A smoking article according to claim 1, wherein in the first configuration the vapour container acts to substantially seal the vapour release portion from the airflow pathway.

4. A smoking article according to claim 1, wherein at least one of said first and second segments comprise filtration material.

5. A smoking article according to claim 1, further comprising a cylindrical filter segment, wherein said first segment is coupled to the filter segment.

6. A smoking article according to claim 5, further comprising a first tipping paper wrapped around the second segment, and a second tipping paper wrapped around the filter segment, wherein in the first configuration one of the first tipping paper and the second tipping paper overlays the respective other tipping paper, and in the second configuration the first tipping paper and second tipping paper act to define a cavity surrounding at least a portion of the first segment.

7. A smoking article according to claim 6, wherein the first and second tipping papers comprise retention means adapted to retain the first tipping paper and second tipping paper together when the first segment and the second segment are in the second configuration.

8. A smoking article according to claim 6, wherein at least one of the first tipping paper and the second tipping paper comprises at least one indicator, wherein in the first configuration the indicator is not exposed, and in the second configuration the at least one indicator is exposed.

9. A smoking article according to claim 1, wherein the first segment and the second segment are movable to a third configuration, wherein a first section of the vapour release portion is exposed and a second section of the vapour release portion is substantially isolated in the second configuration, and the first section of the vapour release portion is substantially isolated and the second section of the vapour release portion is exposed in the third configuration.

10. A smoking article according to claim 9, wherein the first section of the vapour release portion comprises a first vapour component, and the second section of the vapour release portion comprises a second vapour component.

11. A smoking article according to claim 1, wherein the first segment and the second segment are movable from the second configuration to the first configuration, wherein the vapour release portion is substantially isolated.

12. A smoking article according to claim 1, wherein the first segment and second segment are adapted to form a multi-component filter, and the aerosol generating substrate is a tobacco rod, wherein, in the first configuration, the vapour release portion is substantially isolated from a smoke pathway, and, in the second configuration, the vapour release portion is exposed to the smoke pathway.

13. A smoking article comprising:

a first segment;

a second segment; and an aerosol generating substrate coupled to the first and second segments;

wherein at least one of the first and second segments comprises a vapour release portion;

wherein the first and second segments are movable relative to each other from a first configuration to a second configuration such that the smoking article is provided with a changeable length;

wherein in the first configuration the first segment and the second segment interact to form an airflow pathway that does not incorporate the vapour release portion, the vapour release portion being thus substantially isolated from the airflow pathway, wherein in the second configuration the vapour release portion is exposed to the airflow pathway, and wherein the second segment comprises the vapour release portion and defines a cavity that is adapted to receive at least a section of the first segment, said first segment has permeable end surfaces and a substantially impermeable side surface, and said second segment has a permeable inner surface and substantially impermeable end surfaces, such that in the first configuration the impermeable surfaces form a vapour container to isolate the vapour release portion from the airflow pathway.

14. A smoking article according to claim 13, wherein the first segment is movable relative to the second segment, such that in the first configuration the longitudinal length of the smoking article is shorter than in the second configuration.

15. A smoking article according to claim 13, wherein in the first configuration the vapour container acts to substantially seal the vapour release portion from the airflow pathway.

16. A smoking article according to claim 13, wherein at least one of said first and second segments comprise filtration material.

17. A smoking article according to claim 13, further comprising a cylindrical filter segment, wherein said first segment is coupled to the filter segment.

18. A smoking article according to claim 17, further comprising a first tipping paper wrapped around the second segment, and a second tipping paper wrapped around the filter segment, wherein in the first configuration one of the first tipping paper and the second tipping paper overlays the respective other tipping paper, and in the second configuration the first tipping paper and second tipping paper act to define a cavity surrounding at least a portion of the first segment.

19. A smoking article according to claim 18 wherein the first and second tipping papers comprise retention means adapted to retain the first tipping paper and second tipping paper together when the first segment and the second segment are in the second configuration.

20. A smoking article according to claim 18, wherein at least one of the first tipping paper and the second tipping paper comprises at least one indicator, wherein in the first configuration the indicator is not exposed, and in the second configuration the at least one indicator is exposed.

21. A smoking article according to claim 13, wherein the first segment and the second segment are movable to a third configuration, wherein a first section of the vapour release portion is exposed and a second section of the vapour release portion is substantially isolated in the second configuration, and the first section of the vapour release portion is substantially isolated and the second section of the vapour release portion is exposed in the third configuration.

22. A smoking article according to claim 21, wherein the first section of the vapour release portion comprises a first vapour component, and the second section of the vapour release portion comprises a second vapour component.

23. A smoking article according to claim 13, wherein the first segment and the second segment are movable from the second configuration to the first configuration, wherein the vapour release portion is substantially isolated.

24. A smoking article according to claim 13, wherein the first segment and second segment are adapted to form a multi-component filter, and the aerosol generating substrate is a tobacco rod, wherein, in the first configuration, the vapour release portion is substantially isolated from a smoke pathway, and, in the second configuration, the vapour release portion is exposed to the smoke pathway.

* * * * *